US011856978B2

(12) United States Patent
Kim et al.

(10) Patent No.: US 11,856,978 B2
(45) Date of Patent: Jan. 2, 2024

(54) AEROSOL-GENERATING ARTICLE INCLUDING AGAR, GLYCERN, AND WATER

(71) Applicant: KT&G CORPORATION, Daejeon (KR)

(72) Inventors: Min Kyu Kim, Daejeon (KR); Sung Jong Ki, Daejeon (KR); Han Joo Chung, Daejeon (KR); Yong Sook Jin, Daejeon (KR); Dae Nam Han, Daejeon (KR); Jung Ho Han, Gyeongsan-si (KR); Tae Hun Kim, Yongin-si (KR); Sang Kyu Park, Hwaseong-si (KR); Hwi Kyeong An, Seoul (KR); Jae Min Lee, Siheung-si (KR); Jong Sub Lee, Seongnam-si (KR); Hun Il Lim, Seoul (KR)

(73) Assignee: KT&G CORPORATION, Daejeon (KR)

( * ) Notice: Subject to any disclaimer, the term of this patent is extended or adjusted under 35 U.S.C. 154(b) by 410 days.

(21) Appl. No.: 16/959,247

(22) PCT Filed: Jan. 3, 2019

(86) PCT No.: PCT/KR2019/000094
§ 371 (c)(1),
(2) Date: Jun. 30, 2020

(87) PCT Pub. No.: WO2019/135618
PCT Pub. Date: Jul. 11, 2019

(65) Prior Publication Data

US 2021/0051993 A1 Feb. 25, 2021

(30) Foreign Application Priority Data

Jan. 3, 2018 (KR) ..... 10-2018-0000870
Jan. 26, 2018 (KR) ..... 10-2018-0009907
Jan. 3, 2019 (KR) ..... 10-2019-0000666

(51) Int. Cl.
*A24F 40/10* (2020.01)
*A24F 40/20* (2020.01)
(Continued)

(52) U.S. Cl.
CPC ..... *A24B 15/167* (2016.11); *A24D 1/20* (2020.01); *A24F 40/10* (2020.01); *A24F 40/20* (2020.01); *A24F 40/42* (2020.01)

(58) Field of Classification Search
CPC ..... A24B 15/16; A24B 15/167; A24B 15/283; A24D 1/20; A24D 3/06; A24D 3/061;
(Continued)

(56) References Cited

U.S. PATENT DOCUMENTS 4,966,171 A 10/1990 Serrano et al.
5,240,016 A * 8/1993 Nichols ..... A24B 15/165 131/194
(Continued)

FOREIGN PATENT DOCUMENTS

CN 104382224 A 3/2015
CN 104411192 A 3/2015
(Continued)

OTHER PUBLICATIONS

Communication dated May 18, 2021 from the Japanese Patent Office in Application No. 2020-536170.
(Continued)

*Primary Examiner* — Abdullah A Riyami
*Assistant Examiner* — Thang H Nguyen
(74) *Attorney, Agent, or Firm* — Sughrue Mion, PLLC

(57) ABSTRACT

An aerosol-generating article may be fabricated in the form of a bead. For example, the aerosol-generating article may be fabricated in the form of a sphere having a predetermined
(Continued)

diameter. Alternatively, the aerosol-generating article may be fabricated in an oval shape, a droplet shape, etc. Also, the aerosol-generating article may be fabricated in various sizes.

6 Claims, 20 Drawing Sheets

(51) Int. Cl.
*A24B 15/167* (2020.01)
*A24F 40/42* (2020.01)
*A24D 1/20* (2020.01)

(58) Field of Classification Search
CPC . A24D 3/10; A24F 40/10; A24F 40/20; A24F 40/42
See application file for complete search history.

(56) References Cited

U.S. PATENT DOCUMENTS

| | | | | |
|---|---|---|---|---|
| 5,692,525 | A | 12/1997 | Counts et al. | |
| 8,555,896 | B2 * | 10/2013 | Karles | C01B 32/336 264/29.4 |
| 9,907,336 | B2 | 3/2018 | Cashmore et al. | |
| 10,123,560 | B2 * | 11/2018 | Rasouli | A24D 1/00 |
| 10,842,192 | B2 * | 11/2020 | Mironov | A61M 11/042 |
| 2007/0012327 | A1 | 1/2007 | Karles et al. | |
| 2015/0136154 | A1 * | 5/2015 | Mitrev | A24D 1/20 131/328 |
| 2015/0335070 | A1 * | 11/2015 | Sears | A24F 40/30 131/328 |
| 2016/0120224 | A1 | 5/2016 | Mishra et al. | |
| 2017/0000188 | A1 * | 1/2017 | Nordskog | A24B 15/165 |
| 2017/0065000 | A1 * | 3/2017 | Sears | A24F 40/30 |
| 2020/0281257 | A1 | 9/2020 | Kim et al. | |

FOREIGN PATENT DOCUMENTS

| | | | |
|---|---|---|---|
| CN | 104470382 | A | 3/2015 |
| CN | 102977412 | B | 5/2015 |
| CN | 105934168 | A | 9/2016 |
| CN | 106572705 | A | 4/2017 |
| EP | 0503767 | A1 | 9/1992 |
| EP | 2854577 | B1 | 7/2016 |
| JP | 2-84165 | A | 3/1990 |
| JP | 5-153946 | A | 6/1993 |
| JP | 2007-267749 | A | 10/2007 |
| JP | 2015-515857 | A | 6/2015 |
| JP | 2015-519915 | A | 7/2015 |
| JP | 2017-506076 | A | 3/2017 |
| JP | 2017-515493 | A | 6/2017 |
| KR | 10-1336486 | B1 | 12/2013 |
| KR | 10-1564794 | B1 | 10/2015 |
| KR | 10-2017-0007441 | A | 1/2017 |
| WO | 2016159648 | A1 | 10/2016 |
| WO | 2017004185 | A2 | 1/2017 |
| WO | 2017/055456 | A1 | 4/2017 |
| WO | 2017055456 | A1 | 4/2017 |
| WO | 2017/178394 | A1 | 10/2017 |
| WO | 2017/207586 | A1 | 12/2017 |
| WO | 2017207586 | A1 | 12/2017 |
| WO | 2018/019543 | A1 | 2/2018 |
| WO | 2018019578 | A1 | 2/2018 |
| WO | 2018019738 | A1 | 2/2018 |
| WO | 2018224339 | A1 | 12/2018 |

OTHER PUBLICATIONS

First Office Action dated Sep. 2, 2021 from The State Intellectual Property Office of P.R. of China in Application No. 201980006683.2.

Wang Zhang et al., "Food Chemistry", China Light Industry Publishing House, Jan. 2010, pp. 73-74 (4 pages).

Yu Xin et al., "Natural Food Additives", China Light Industry Publishing House, Mar. 2014, p. 189 (3 pages).

Extended European Search Report dated Sep. 8, 2021 in Appl. No. 19735868.2.

International Search Report of PCT/KR2019/000094 dated Apr. 9, 2019 [PCT/ISA/210].

Communication dated Aug. 31, 2020 from the Korean Intellectual Property Office in Application No. 10-2019-0000666.

* cited by examiner

AEROSOL-GENERATING ARTICLE INCLUDING AGAR, GLYCERN, AND WATER

CROSS REFERENCE TO RELATED APPLICATIONS

This application is a National Stage of International Application No. PCT/KR2019/000094, filed Jan. 3, 2019, claiming priority to Korean Patent Application Nos. 10-2018-0000870, filed Jan. 3, 2018, Korean Patent Application No. 10-2018-0009907, filed Jan. 26, 2018 and Korean Patent Application No. 10-2019-0000666, filed Jan. 3, 2019.

TECHNICAL FIELD

One or more embodiments relate to an article for generating aerosols and an apparatus for generating aerosols.

BACKGROUND ART

Recently, there is a growing demand for alternative methods for resolving problems of common cigarettes. For example, there is growing demand for a method of generating aerosol by heating an aerosol generating material in a cigarette instead of combusting the cigarette to generate aerosol. Therefore, research on heating-type cigarettes or heating-type aerosol generating apparatuses is actively being carried out.

DESCRIPTION OF EMBODIMENTS

Technical Problem

One or more embodiments include an article for generating aerosols and an apparatus for generating aerosols. Technical problems to be solved are not limited to the technical problems as described above, and other technical problems may exist.

Solution to Problem

According to one or more embodiments, an aerosol-generating article comprises agar, glycerin, and water, maintains the shape of a bead by itself at room temperature, and generates aerosol by being heated by an electric heater included in an aerosol-generating device.

The aerosol-generating article may include 1.0 wt % to 2.5 wt % of agar, 70 wt % of glycerin, and 27.5 wt % to 29.0 wt % of water.

The aerosol-generating article may include 2.5 wt % of agar, 60 wt % to 90 wt % of glycerin, and 7.5 wt % to 37.5 wt % of water.

The aerosol-generating article may further include alginate.

The aerosol-generating article may include 2.5 wt % of agar, 60 wt % of glycerin, 0.05 wt % to 0.15 wt % of alginate, and 37.35 wt % to 37.45 wt % of water.

The aerosol-generating article may include 2.5 wt % of agar, 70 wt % of glycerin, 0.05 wt % to 0.15 wt % of alginate, and 27.35 wt % to 27.45 wt % of water.

The heater may be inserted into a cigarette or a cartridge including the aerosol-generating article and heat the aerosol-generating article.

The heater may heat the aerosol-generating article outside of a cigarette or a cartridge including the aerosol-generating article.

The heater may generate the aerosol by heating a material generated by liquefying the aerosol-generating article.

According to one or more embodiments, a cigarette may include the aerosol-generating article described above and at least one filter.

According to one or more embodiments, a cartridge may include an accommodating portion, which is configured to accommodate the aerosol-generating article as described above, and at least one heater.

Advantageous Effects of Disclosure

An aerosol-generating article may be in the form of a bead. For example, the aerosol-generating article may be fabricated in the form of a sphere having a predetermined diameter. Alternatively, the aerosol-generating article may be fabricated in an oval shape, a droplet shape, etc. Also, the aerosol-generating article may be fabricated in various sizes.

BEST MODE

Figure 1:
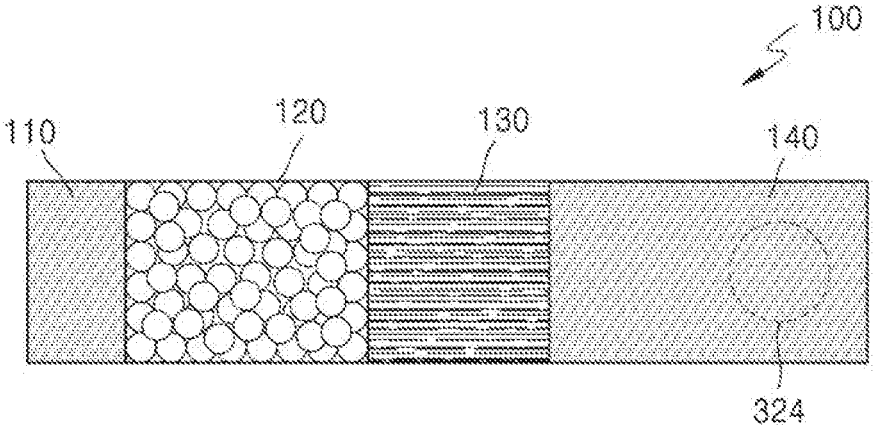
FIG. 1 is a drawing showing an example of a cigarette including beads.

According to one or more embodiments, an aerosol-generating article comprises agar, glycerin, and water, maintains the shape of a bead by itself at room temperature, and generates aerosol when heated by an electric heater included in an aerosol-generating device.

Mode of Disclosure

With respect to the terms in the various embodiments of the present disclosure, the general terms which are currently and widely used are selected in consideration of functions of structural elements in the various embodiments of the present disclosure. However, meanings of the terms may be changed according to intention, a judicial precedent, appearance of a new technology, and the like. In addition, in certain cases, there is also a term arbitrarily selected by the applicant, in which case the meaning will be described in detail in the description of one or more embodiments. Therefore, the terms used in one or more embodiments should be defined based on the meanings of the terms and the general contents of one or more embodiments, rather than simply the names of the terms.

Hereinafter, exemplary embodiments of one or more embodiments will be described in detail with reference to the accompanying drawings. One or more embodiments may, however, be embodied in many different forms and should not be construed as being limited to the embodiments set forth herein.

Hereinafter, an aerosol-generating article may be in the form of a bead. For example, the aerosol-generating article may be fabricated in the form of a sphere having a predetermined diameter. Alternatively, the aerosol-generating article may be fabricated in an oval shape, a droplet shape, etc. Also, the aerosol-generating article may be fabricated in various sizes.

The aerosol-generating article retains the shape of a bead at the room temperature by itself. In detail, the aerosol-generating article retains the shape of a bead until being liquefied or vaporized by a heater, which will be described below. In other words, the aerosol-generating article does not include a separate outer membrane (outer shell) to retain the shape of a bead and naturally has the shape of the bead as materials to be described below are mixed and dried. Therefore, no residue remains after the aerosol-generating article is liquefied or vaporized. Hereinafter, the aerosol-generating article will be referred to as a 'bead'.

For example, a bead may be fabricated by using agar, glycerin, and water. For example, a bead may be fabricated by combining 1 wt % to 3 wt % of agar, 10 wt % to 80 wt % of glycerin, and 25 wt % to 90 wt % of water with respect to the total weight of the bead. However, the ratio of agar, glycerin, and water is not limited to the above-stated one, and various composition ratios may be applied thereto.

For example, a bead may be fabricated by combining 1.0 wt % to 2.5 wt % of agar, 70 wt % of glycerin, and 27.5 wt % to 20 wt % of water with respect to the total weight of the bead. In particular, when a bead was fabricated by combining 2.0 wt % to 2.5 wt % of agar, 70 wt % of glycerin, and 27.5 wt % to 28.0 wt % of water, the bead exhibited excellent moldability.

Also, a bead may be fabricated by combining 2.5 wt % of agar, 60 wt % to 90 wt % of glycerin, and 7.5 wt % to 37.5 wt % of water with respect to the total weight of the bead. In particular, when a bead was fabricated by combining 2.5 wt % of agar, 60 wt % to 80 wt % of glycerin, and 17.5 wt % to 37.5 wt % of water, the bead exhibited excellent moldability.

In another example, a bead may be fabricated by using agar, glycerin, water, and alginate.

For example, a bead may be fabricated by combining 2.5 wt % of agar, 60 wt % of glycerin, 0.05 wt % to 0.15 wt % of alginate, and 37.35 wt % to 37.45 wt % of water with respect to the total weight of the bead. In particular, when a bead was fabricated by combining 2.5 wt % of agar, 60 wt % of glycerin, 0.05 wt % to 0.10 wt % of alginate, and 37.40 wt % to 37.45 wt % of water, the bead exhibited excellent moldability.

Also, a bead may be fabricated by combining 2.5 wt % of agar, 70 wt % of glycerin, 0.05 wt % to 0.15 wt % of alginate, and 27.35 wt % to 27.45 wt % of water with respect to the total weight of the bead. In particular, when a bead was fabricated by combining 2.5 wt % of agar, 70 wt % of glycerin, 0.05 wt % to 0.10 wt % of alginate, and about 27.40 wt % to about 27.45 wt % of water, the bead exhibited excellent moldability.

Also, instead of agar described above, pectin, sodium alginate, carrageenan, gelatin or a gum like guar gum may be used.

Also, the components of a bead are not limited to agar, glycerin, water, and alginate described above. For example, a bead may further include propylene glycol, nicotine, a flavoring agent, etc. For example, a bead may further include 1.0 wt % of nicotine. When nicotine is further included in a bead, the phenomenon of unnecessary leakage from an aerosol-generating device as the bead is heated by a heater may be prevented.

Meanwhile, the components of a bead are not limited to the above-described substances, and various other substances constituting a cigarette may also be included.

The surface of a bead may be coated with a predetermined material. For example, to prevent loss of moisture and the like included in a bead, the surface of the bead may be coated with a predetermined material. For example, the surface of a bead may be coated with tobacco powder, but one or more embodiments are not limited thereto.

In addition, a drying operation may be included in operations for fabricating a bead. For example, during fabrication of a bead, a molded bead may be dried by being exposed to hot air, and the hardness of the bead may be improved as the bead is dried.

For example, the hardness of a dried bead may be within the range of 2.0 to 7.0. Here, the hardness refers to the degree of resistance against crushing (that is, deformation of the appearance) of the bead due to external force applied to the bead. The hardness is a relative value. The larger the number of the hardness is, the stronger the hardness becomes (that is, more external force is needed to deform a bead). The hardness of beads was derived through evaluations with 100 people, and the degrees of maintaining the appearance when beads were pressed by hand were quantified in steps from 0 to 10.

For example, a bead formed with the composition ratio of 2.5 wt % of agar, 60 wt % of glycerin, 0 wt % to 0.10 wt % of alginate, and 37.40 wt % to 37.50 wt % of water may exhibit hardness from about 2.0 to about 6.5 after being dried. Also, a bead formed with the composition ratio of 2.5 wt % of agar, 70 wt % of glycerin, 0 wt % to 0.10 wt % of alginate, and 27.40 wt % to 27.50 wt % of alginate may exhibit hardness from about 1.7 to about 6.3 as being dried.

A bead may be included in a cigarette and/or accommodated in a cartridge. For example, a cigarette or a cartridge including a bead may be heated by an electric heater to generate aerosol. Also, a bead may or may not include nicotine.

Hereinafter, examples in which beads are used will be described with reference to FIGS. 1 to 17. Even when omitted below, the descriptions given above in relation to beads may be applied to beads to be described below with reference to FIGS. 1 to 17.

FIG. 1 is a drawing showing an example of a cigarette including beads.

Referring to FIG. 1, a cigarette 100 includes a front-end plug 110, a bead accommodating portion 120, a tobacco accommodating portion 130, and a filter 140. Meanwhile, although not shown in FIG. 1, the cigarette 100 may be packaged by at least one wrapper.

The front-end plug 110 may include cellulose acetate. For example, the front-end plug 100 may be fabricated by molding a cellulose acetate tow by adding a plasticizer (e.g., triacetin, etc.) thereto. Alternatively, the front-end plug 110 may include other material such as cotton. Therefore, the front-end plug 110 may also serve as a wick that absorbs a liquid produced as a bead melts.

The bead accommodating portion 120 includes at least one bead as described above. Here, the bead may not include nicotine, but is not limited thereto. When a plurality of beads are accommodated in the bead accommodating portion 120, the plurality of beads may be arranged regularly or irregularly.

The tobacco accommodating portion 130 includes an aerosol generating material. For example, the aerosol generating material may include at least one of glycerin, propylene glycol, ethylene glycol, dipropylene glycol, diethylene glycol, triethylene glycol, tetraethylene glycol, and oleyl alcohol.

In addition, the tobacco accommodating portion 130 may include other additive materials like a flavoring agent, a wetting agent, and/or an organic acid. For example, the flavoring agent may include licorice, sucrose, fructose syrup, isosweet, cocoa, lavender, cinnamon, cardamom, celery, fenugreek, cascara, sandalwood, bergamot, geranium, honey essence, rose oil, vanilla, lemon oil, orange oil, mint oil, cinnamon, keragene, cognac, jasmine, chamomile, menthol, cinnamon, ylang, salvia, spearmint, ginger, coriander, coffee, etc. In addition, the wetting agent may include glycerin or propylene glycol.

For example, the tobacco accommodating portion 130 may be filled with cut tobacco leaves. Here, cut tobacco leaves may be formed by fine-cutting a tobacco sheet.

In another example, the tobacco accommodating portion 130 may be filled with a plurality of cigarette strands formed by fine-cutting a tobacco sheet. For example, the tobacco accommodating portion 130 may be formed by combining a plurality of tobacco strands in the same direction (parallel to one another) or randomly. In detail, the tobacco accommodating portion 130 may be formed by combining a plurality of tobacco strands, and a plurality of vertical channels through which aerosol may pass may be formed. At this time, depending on the sizes and arrangements of the tobacco strands, the vertical channels may be uniform or non-uniform.

For example, tobacco strands may be formed through the following operations. First, a raw tobacco material is pulverized to form a slurry in which an aerosol generating material (e.g., glycerin, propylene glycol, etc.), a flavoring liquid, a binder (e.g., guar gum, xanthan gum, carboxymethyl cellulose (CMC), etc.), and water are mixed, and then a sheet is formed by using the slurry. When forming the slurry, natural pulp or cellulose may be added to modify the physical properties of tobacco strands, and one or more binders may be mixed and used. Next, after drying the sheet, tobacco strands may be formed by fold-cutting or fine-cutting the dried sheet.

The raw tobacco material may be tobacco leaf fragments, tobacco stems, and/or fine tobacco powders formed during treatment of tobacco. The tobacco sheet may also include other additives like wood cellulose fibers.

The slurry may contain 5% to 40% of aerosol generating material, and 2% to 35% of aerosol generating material may remain in completed tobacco strands. Preferably, 10% to 25% of the aerosol generating material may remain in the completed tobacco strands.

Also, a flavoring agent such as menthol or a moisturizing agent may be added to the tobacco accommodating portion 130.

The filter 140 may include cellulose acetate. For example, the filter 140 may be fabricated as a recess filter, but is not limited thereto. The length of the filter 140 may be appropriately selected within the range of 4 mm to 20 mm. For example, the length of the filter 140 may be about 12 mm, but is not limited thereto.

During a process of fabricating the filter 140, the filter 140 may be fabricated to emit a flavor by spraying a flavoring solution to the filter 140. Alternatively, separate fibers coated with a flavoring liquid may be inserted into the filter 140. Aerosols generated by the bead accommodating portion 120 and tobacco accommodating portion 130 are delivered to a user through the filter 140. Therefore, when a flavoring material is added to the filter 140, the persistence of a flavor delivered to the user may be enhanced.

Also, the filter 140 may include at least one capsule. Here, the capsule may have a structure in which a content liquid containing a flavoring material is wrapped with a film. For example, the capsule may have a spherical or cylindrical shape.

The outer film (outer cover) of the capsule may be fabricated by using a material including agar, pectin, sodium alginate, carrageenan, gelatin, or a gum like guar gum. Furthermore, a hardening agent may be further used as a material for forming the film of the capsule 324. Here, as the gelling agent, for example, a calcium chloride group may be used. Furthermore, a plasticizer may be further used as a material for forming the film of the capsule. As the plasticizer, glycerin and/or sorbitol may be used. Furthermore, a coloring agent may be further used as a material for forming the film of the capsule 324.

For example, as a flavoring material included in the content liquid of the capsule 324, menthol, plant essential oil, and the like may be used. As a solvent of the flavoring material included in the content liquid, for example, a medium chain fatty acid triglyceride (MCT) may be used. Also, the content liquid may include other additives like a figment, an emulsifying agent, a thickening agent, etc.

Figure 2:
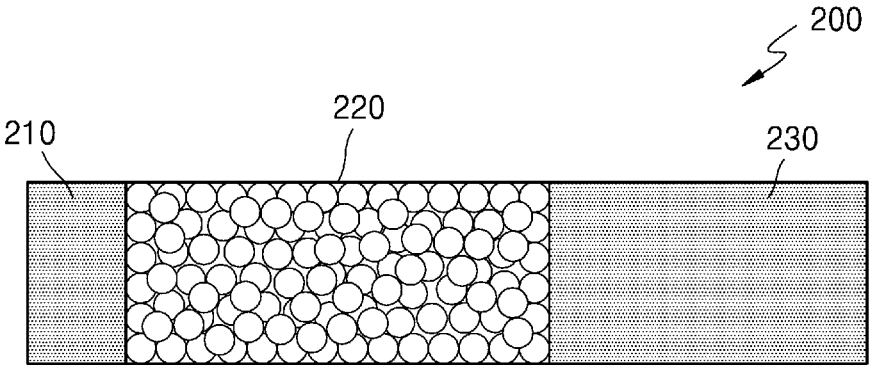
FIG. 2 is a drawing showing another example of a cigarette including beads.

FIG. 2 is a drawing showing another example of a cigarette including beads.

Referring to FIG. 2, a cigarette 200 includes a front-end plug 210, a bead accommodating portion 220, and a filter 230. Here, the front-end plug 210 and the filter 230 are the same as those described above with reference to FIG. 1. Therefore, descriptions of the front-end plug 210 and the filter 230 will be omitted below.

The bead accommodating portion 220 includes at least one bead as described above. Here, the bead may be a bead that includes nicotine, but is not limited thereto. When a plurality of beads are accommodated in the bead accommodating portion 220, the plurality of beads may be arranged regularly or irregularly.

Figure 3:
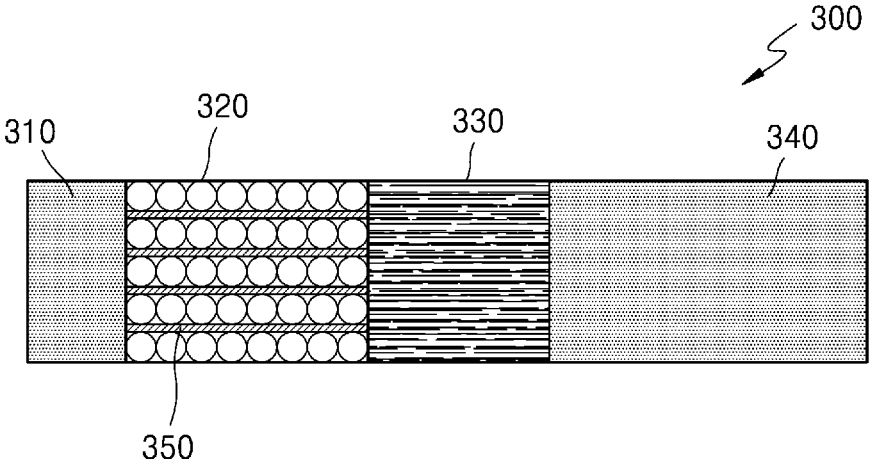
FIG. 3 is a drawing showing another example of a cigarette including beads.

FIG. 3 is a drawing showing another example of a cigarette including beads.

Referring to FIG. 3, a cigarette 300 includes a front-end plug 310, a bead accommodating portion 320, a tobacco accommodating portion 330, and a filter 340. Here, the front-end plug 310, the tobacco accommodating portion 330, and the filter 340 are the same as those described above with reference to FIG. 1. Therefore, descriptions of the front-end plug 310, the tobacco accommodating portion 330, and the filter 340 will be omitted below.

The bead accommodating portion 330 includes at least one bead as described above. Here, bead may be a bead that does not include nicotine, but is not limited thereto.

The bead accommodating portion 330 may further include a carrier 350. For example, the carrier 350 may be included in the bead accommodating portion 330 for the purpose of fixing beads or absorbing liquid discharged from the beads. However, the functions of the carrier 350 are not limited thereto.

Meanwhile, FIG. 3 shows that the carrier 350 is rectangular, but the shape of the carrier 350 is not limited thereto. In other words, as long as the carrier 350 is capable of fixing the beads and/or absorbing liquid discharged from the beads, the shape (or structure) of the carrier 350 is not limited. For example, the carrier 350 may be formed in a matrix shape or a honeycomb shape.

Figure 4:
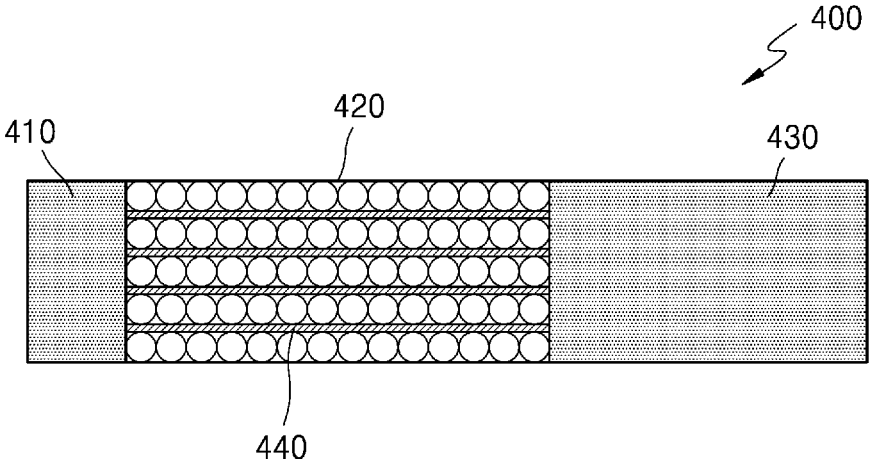
FIG. 4 is a drawing showing another example of a cigarette including beads.

FIG. 4 is a drawing showing another example of a cigarette including beads.

Referring to FIG. 4, a cigarette 400 includes a front-end plug 410, a bead accommodating portion 420, and a filter 430. Here, the front-end plug 410 and the filter 430 are the same as those described above with reference to FIG. 1. Therefore, descriptions of the front-end plug 410 and the filter 430 will be omitted below.

The bead accommodating portion 420 includes at least one bead as described above. Here, the bead may be a bead that includes nicotine, but is not limited thereto.

The bead accommodating portion 420 may further include a carrier 440. Here, the carrier 440 is the same as that described above with reference to FIG. 3. Therefore, description of the carrier 440 will be omitted below.

Figure 5:
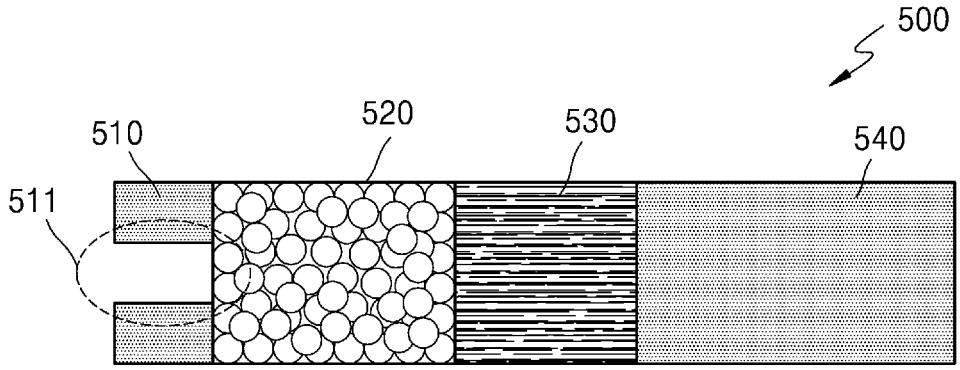
FIG. 5 is a drawing showing another example of a cigarette including beads.

FIG. 5 is a drawing showing another example of a cigarette including beads.

Referring to FIG. 5, a cigarette 500 includes a front-end plug 510, a bead accommodating portion 520, a tobacco accommodating portion 530, and a filter 540. Here, the bead accommodating portion 520, the tobacco accommodating portion 530, and the filter 540 are the same as those described above with reference to FIG. 1. Therefore, descriptions of the bead accommodating portion 520, the tobacco accommodating portion 530, and the filter 540 will be omitted below.

The front-end plug 510 may include a porous ceramic material. Also, the front-end plug 510 may include cellulose acetate, as described above with reference to FIG. 1.

The front-end plug 510 may include a cavity 511. For example, the front-end plug 510 may be fabricated in the form of a tube. Here, the cavity 511 may become a path through which a heater may be inserted into the cigarette 500. The cross-sectional shape of the cavity 511 may vary.

Figure 6:
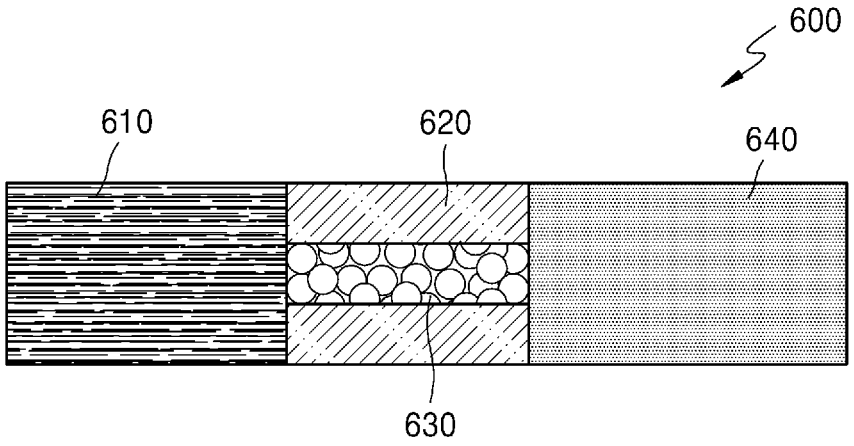
FIG. 6 is a drawing showing another example of a cigarette including beads.

FIG. 6 is a drawing showing another example of a cigarette including beads.

Referring to FIG. 6, a cigarette 600 includes a tobacco accommodating portion 610, a cavity structure 620, and a filter 640. Here, the tobacco accommodating portion 610 and the filter 640 are the same as those described above with reference to FIG. 1. Therefore, descriptions of the tobacco accommodating portion 610 and the filter 640 will be omitted below.

The cavity structure 620 may include cellulose acetate. For example, the cavity structure 620 may be fabricated by molding a cellulose acetate tow by adding a plasticizer (e.g., triacetin, etc.) thereto. Also, a cavity 630 included in the cavity structure 620 may be filled with at least one bead.

Figure 7:
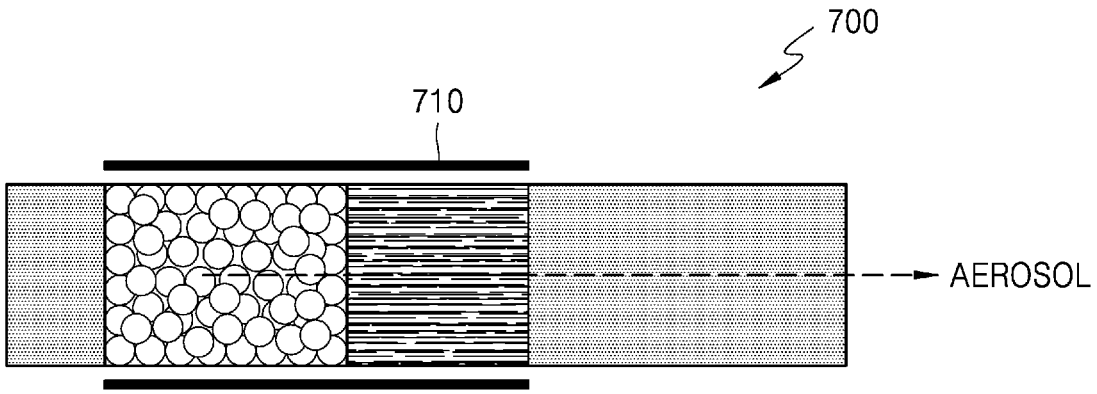
FIG. 7 is a diagram showing an example of heating a cigarette including beads.

FIG. 7 is a diagram showing an example of heating a cigarette including beads.

A cigarette 700 of FIG. 7 is the same as the cigarette 100 shown in FIG. 1. Alternatively, the cigarette 700 may be any one of cigarettes 200, 300, 400, 500, and 600 shown in FIGS. 2 to 6.

A heater 710 may be arranged to heat an entire bead accommodating portion and an entire tobacco accommodating portion of the cigarette 700. For example, the heater 710 may be a cylindrical heater surrounding the bead accommodating portion and the tobacco accommodating portion, but is not limited thereto.

Figure 8:
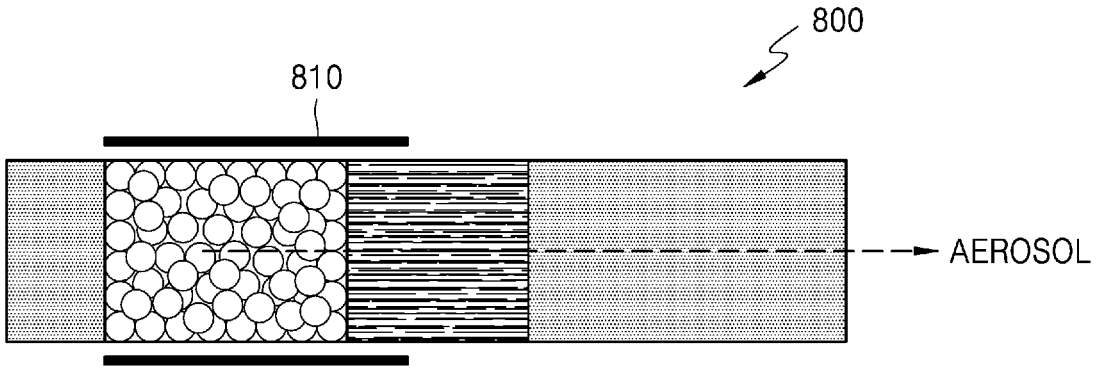
FIG. 8 is a diagram showing another example of heating a cigarette including beads.

FIG. 8 is a diagram showing another example of heating a cigarette including beads.

A cigarette 800 of FIG. 8 is the same as the cigarette 100 shown in FIG. 1. Alternatively, the cigarette 800 may be any one of cigarettes 200, 300, 400, 500, and 600 shown in FIGS. 2 to 6.

A heater 810 may be arranged to heat an entire bead accommodating portion and a portion of a tobacco accommodating portion of the cigarette 800. For example, the heater 810 may be a cylindrical heater, but is not limited thereto.

Figure 9:
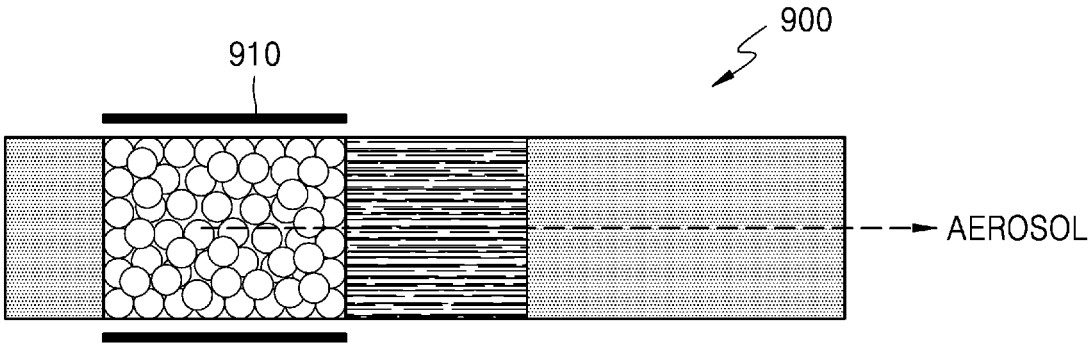
FIG. 9 is a diagram showing another example of heating a cigarette including beads.

FIG. 9 is a diagram showing another example of heating a cigarette including beads.

A cigarette 900 of FIG. 9 is the same as the cigarette 100 shown in FIG. 1. Alternatively, the cigarette 900 may be any one of cigarettes 200, 300, 400, 500, and 600 shown in FIGS. 2 to 6.

A heater 910 may be arranged to heat a bead accommodating portion of the cigarette 900. For example, the heater 910 may be a cylindrical heater, but is not limited thereto.

Figure 10:
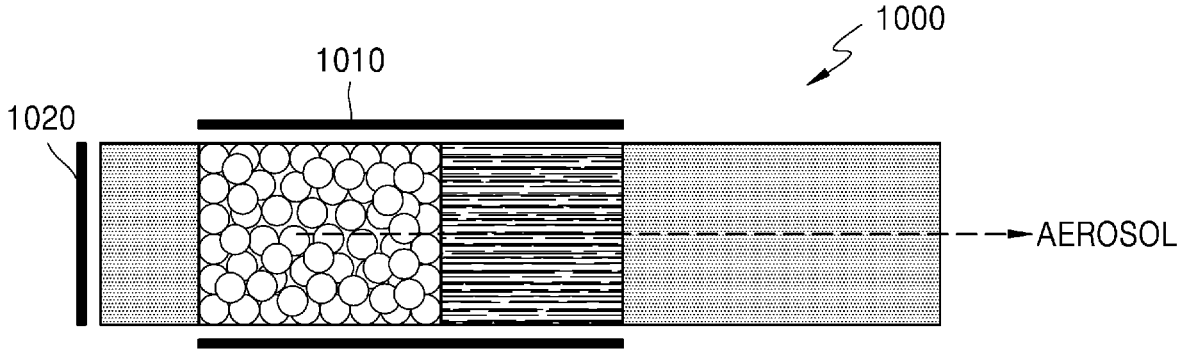
FIG. 10 is a diagram showing another example of heating a cigarette including beads.

FIG. 10 is a diagram showing another example of heating a cigarette including beads.

A cigarette 1000 of FIG. 10 is the same as the cigarette 100 shown in FIG. 1. Alternatively, the cigarette 1000 may be any one of cigarettes 200, 300, 400, 500, and 600 shown in FIGS. 2 to 6.

A first heater 1010 may be arranged to heat an entire bead accommodating portion and an entire tobacco accommodating portion of the cigarette 1000. For example, the first heater 1010 may be a cylindrical heater, but is not limited thereto. Meanwhile, although not shown in FIG. 10, the first heater 1010 may be arranged to heat the entire bead accommodating portion and a portion of the tobacco accommodating portion.

Also, a second heater 1020 may be arranged to heat a front-end plug of the cigarette 1000. At this time, the front-end plug may serve as a wick for liquids.

The first heater 1010 and the second heater 1020 may be controlled to be heated to different temperatures, respectively. For example, at least one of the first heater 1010 and the second heater 1020 may sequentially melt beads included in the bead accommodating portion. Therefore, aerosol may be continuously generated during user's smoking.

For example, aerosol generated from a bead may be moved in the direction indicated in FIG. 10 by the arrow and inhaled by a user. In another example, aerosol generated from a bead may be moved through a flow path formed along a side surface of the cigarette 1000 and inhaled by a user.

Figure 11:
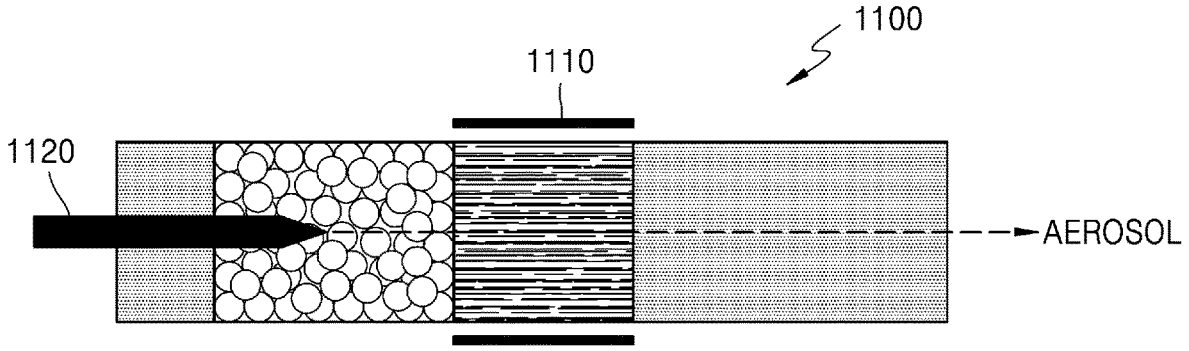
FIG. 11 is a diagram showing another example of heating a cigarette including beads.

FIG. 11 is a diagram showing another example of heating a cigarette including beads.

A cigarette 1100 of FIG. 11 is the same as the cigarette 500 shown in FIG. 5. Alternatively, the cigarette 1100 may be any one of cigarettes 100, 200, 300, 400, and 600 shown in FIGS. 1 to 4 and 6.

A first heater 1110 may be arranged to heat a tobacco accommodating portion of the cigarette 1100. For example, the first heater 1110 may be a cylindrical heater, but is not limited thereto.

Also, a second heater 1120 may be arranged to heat a bead accommodating portion of the cigarette 1100. For example, the second heater 1120 may be inserted into the bead accommodating portion through a front-end plug. Therefore, beads in the bead accommodating portion may be heated. The second heater 1130 may be fabricated in various shapes, e.g., a blade-like shape, a needle-like shape, etc.

The first heater 1110 and the second heater 1120 may be controlled to be heated to different temperatures, respectively. For example, at least one of the first heater 1110 and the second heater 1120 may sequentially melt beads included in the bead accommodating portion. Therefore, aerosols may be continuously generated during user's smoking.

For example, an aerosol generated from a bead may be moved in the direction indicated in FIG. 11 by the arrow and inhaled by a user. In another example, an aerosol generated from a bead may be moved through a flow path (not shown) formed along a side surface of the cigarette 1100 and inhaled by a user.

Figure 12:
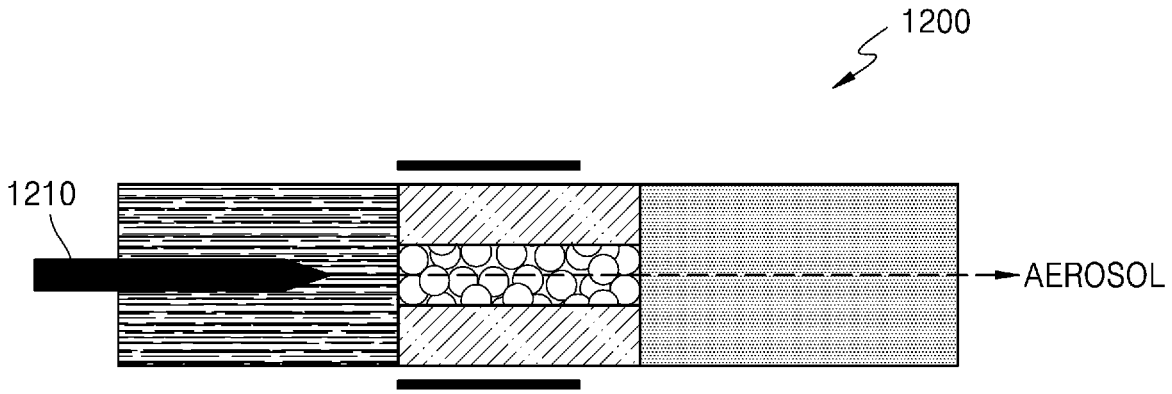
FIG. 12 is a diagram showing another example of heating a cigarette including beads.

FIG. 12 is a diagram showing another example of heating a cigarette including beads.

A cigarette 1200 of FIG. 12 is the same as the cigarette 600 shown in FIG. 6. Alternatively, the cigarette 1200 may be any one of cigarettes 100, 200, 300, 400, and 500 shown in FIGS. 1 to 5.

A heater 1210 may be arranged to heat a tobacco accommodating portion of the cigarette 1200. For example, the heater 1210 may be inserted into the tobacco accommodating portion. The heater 1210 may be fabricated in various shapes, e.g., a blade-like shape, a needle-like shape, etc.

Figure 13:
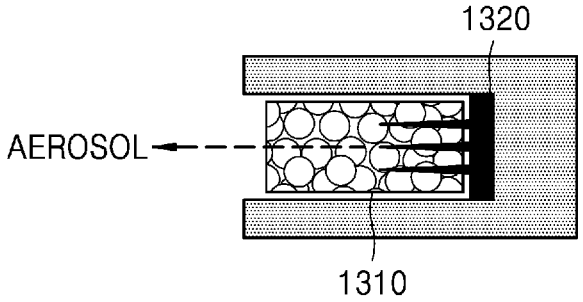
FIG. 13 is a diagram showing an example of heating a cartridge including beads.

FIG. 13 is a diagram showing an example of heating a cartridge including beads.

FIG. 13 shows an example of a cartridge 1310 including beads. A heater 1320 may be arranged to heat the exterior and/or the interior of the cartridge 1310. For example, the heater 1320 may include a piercing element, and beads in the cartridge 1310 may be heated as the piercing element is inserted into the cartridge 1310.

Figure 14:
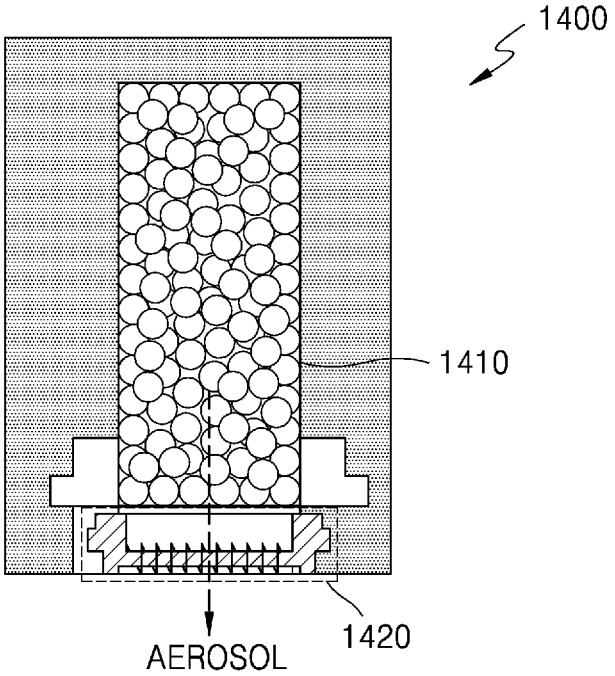
FIG. 14 is a diagram showing another example of heating a cartridge including beads.

FIG. 14 is a diagram showing another example of heating a cartridge including beads.

Referring to FIG. 14, a cartridge 1400 includes a bead accommodating portion 1410 and a heater 1420. However, other components may be further included in the cartridge 1400, and the heater 1420 may be provided as a device independent of the cartridge 1400.

For example, the bead accommodating portion 1410 of the cartridge 1400 may be replaceable. In detail, the bead accommodating portion 1410 may be attached to and detached from the cartridge 1400 or a device in which the cartridge 1400 is accommodated. Therefore, the bead accommodating portion 1410 may be replaced separately from the heater 1420. Meanwhile, the heater 1420 may be fixed to the cartridge 1400 or the device in which the cartridge 1400 is accommodated.

Also, both the bead accommodating portion 1410 and the heater 1420 may be fixed to the cartridge 1400 or the device in which the cartridge 1400 is accommodated. In this case, as needed, a user may directly supply at least one bead into the bead accommodating portion 1410.

The bead accommodating portion 1410 includes at least one bead as described above. Here, the bead may include nicotine, but is not limited thereto. When a plurality of beads are accommodated in the bead accommodating portion 1410, the plurality of beads may be arranged regularly or irregularly. Also, a carrier may be further included in the bead accommodating portion 1410. Here, the carrier is the same as that described above with reference to FIG. 3. Therefore, detailed description of the carrier will be omitted below.

The heater 1420 may include a coil for heating and a wick, but one or more embodiments are not limited thereto. For example, the heater 1420 may be a plate-like heater or a mesh-like heater, but is not limited thereto.

For example, the wick may include cotton fiber, ceramic fiber, glass fiber, or porous ceramic, but is not limited thereto. Also, the heater 1420 may be a metal heating wire, a metal heating plate, or a ceramic heater, but is not limited thereto. Also, a heating element may include a conductive filament such as a nichrome wire.

Figure 15:
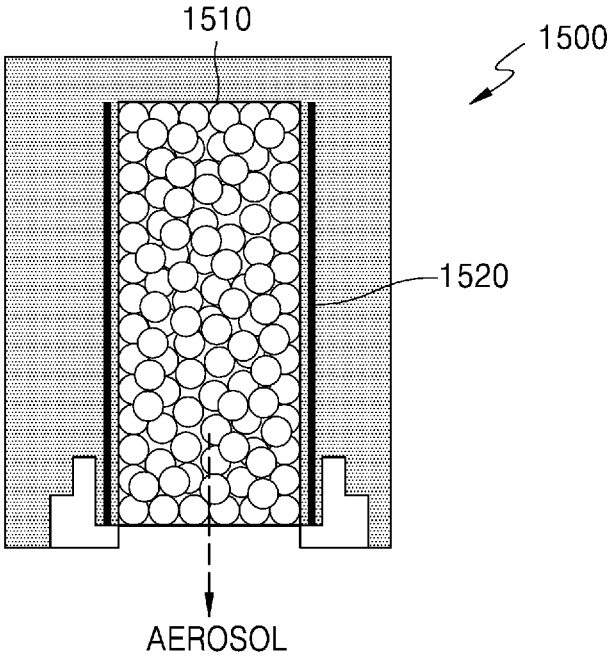
FIG. 15 is a diagram showing another example of heating a cartridge including beads.

FIG. 15 is a diagram showing another example of heating a cartridge including beads.

Referring to FIG. 15, a cartridge 1500 includes a bead accommodating portion 1510 and a heater 1520. However, other components may be further included in the cartridge 1500, and the heater 1520 may be provided as a device independent of the cartridge 1500.

The bead accommodating portion 1510 is the same as the bead accommodating portion 1410 described above with reference to FIG. 14. Therefore, description of the bead accommodating portion 1510 will be omitted below.

The heater 1520 may be provided to heat the entirety or a portion of the bead accommodating portion 1510. For example, the heater 1520 may be a cylindrical heater surrounding the entire or a portion of the bead accommodating portion, but is not limited thereto.

Meanwhile, in addition to the examples shown in FIGS. 14 and 15, other examples of heating a cartridge may be employed. Also, an aerosol may be generated by combining the examples shown in FIGS. 14 and 15. For example, beads may be liquefied by the heater 1520 shown in FIG. 15, and aerosol may be generated from a liquefied material by the heater 1420 shown in FIG. 14.

Figure 16:
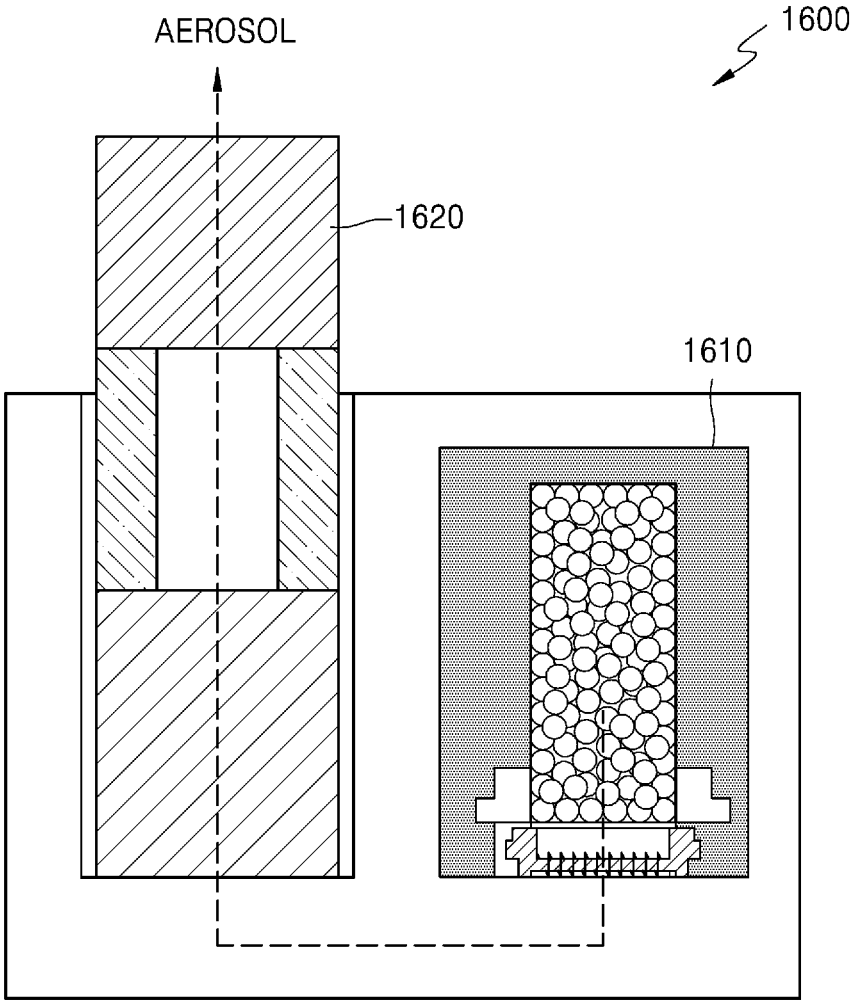
FIG. 16 is a diagram showing an example of a cartridge including beads and a cigarette.

FIG. 16 is a diagram showing an example of a cartridge including beads and a cigarette.

Referring to FIG. 16, a device 1600 includes a cartridge 1610 and a cigarette 1620. Here, the cartridge 1610 is the same as the cartridge 1400 described above with reference to FIG. 14. Therefore, description of the cartridge 1610 will be omitted below.

The aerosol generated from the cartridge 1610 is discharged to the outside through the cigarette 1620, and a user may inhale the aerosol discharged to the outside. Here, the cigarette 1620 may be heated by a separate heater, but is not limited thereto.

Figure 17:
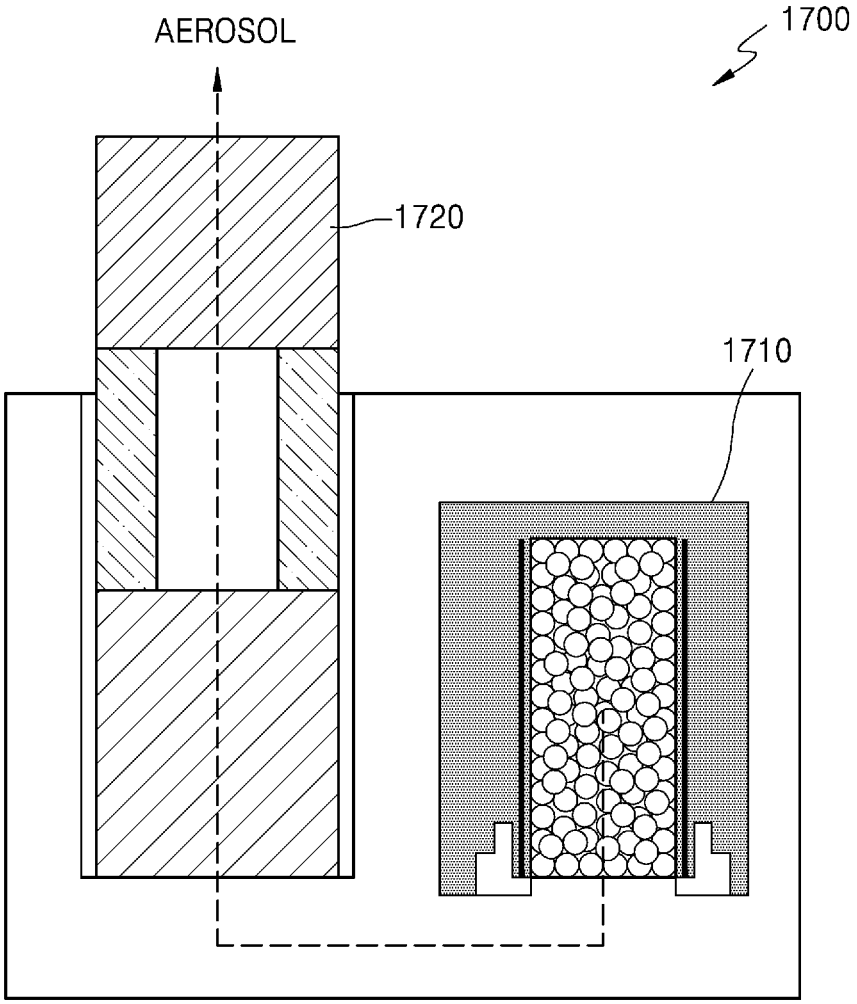
FIG. 17 is a diagram showing another example of a cartridge including beads and a cigarette.

FIG. 17 is a diagram showing another example of a cartridge including beads and a cigarette.

Referring to FIG. 17, a device 1700 includes a cartridge 1710 and a cigarette 1720. Here, the cartridge 1710 is the same as the cartridge 1500 described above with reference to FIG. 15. Therefore, hereinafter, description of the cartridge 1710 is omitted.

An aerosol generated from the cartridge 1710 is discharged to the outside through the cigarette 1720, and a user may inhale the aerosol discharged to the outside. Here, the cigarette 1720 may be heated by a separate heater, but is not limited thereto.

Figure 18:
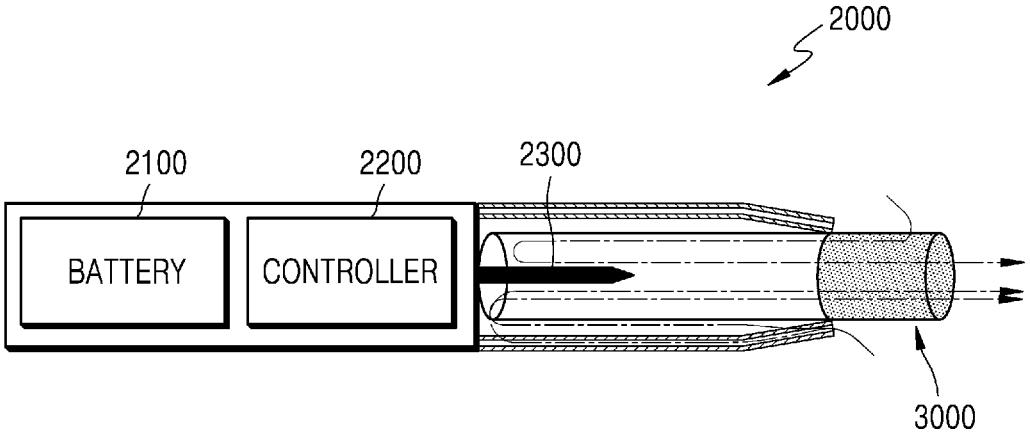
FIGS. 18 to 20 are diagrams showing examples of an aerosol generating device.
Figure 19:
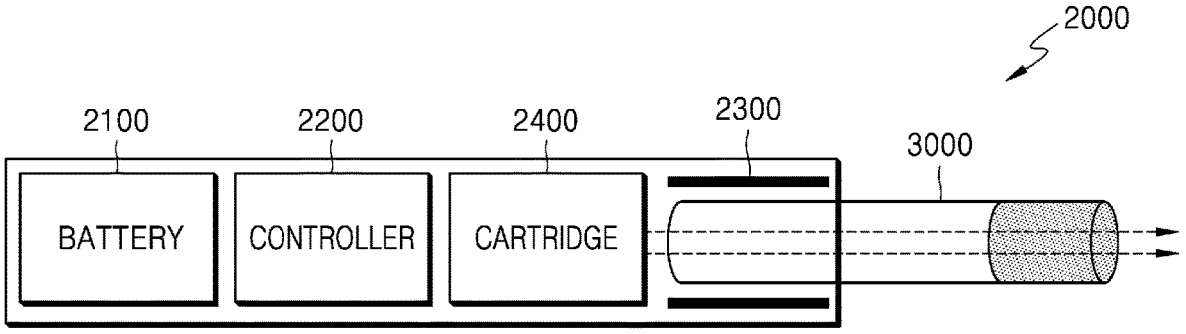
Figure 20:
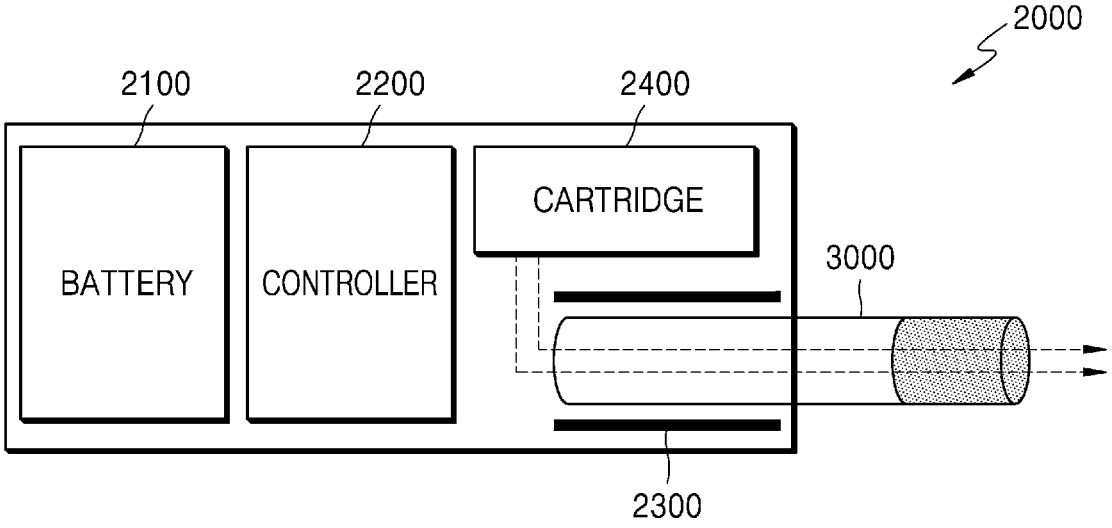

FIGS. 18 to 20 are diagrams showing examples in which a cigarette is inserted into an aerosol generating device.

Referring to FIG. 18, an aerosol generating device 2000 includes a battery 2100, a controller 2200 and a heater 2300. Referring to FIGS. 19 and 20, an aerosol generating device 2000 further includes a cartridge 2400. Also, a cigarette 3000 may be inserted into an inner space of the aerosol generating device 2000. Here, the cigarette 3000 may be a cigarette described with reference to FIGS. 1 to 12.

FIGS. 18 to 20 only illustrate components of the aerosol generating device 2000 which are related to the present embodiment. However, it will be understood by one of ordinary skill in the art related to the present embodiment that other general-purpose components may be further included in the aerosol generating device 2000, in addition to the components illustrated in FIGS. 18 to 20.

Also, FIGS. 19 and 20 illustrate that the aerosol generating device 2000 includes the heater 2300. However, as necessary, the heater 2300 may be omitted.

FIG. 18 illustrates that the battery 2100, the controller 2200, and the heater 2300 are arranged in series. FIG. 19 illustrates that the battery 2100, the controller 2200, the cartridge 2400, and the heater 2300 are arranged in series. Also, FIG. 19 illustrates that the cartridge 2400 and the heater 2300 are arranged in parallel. However, the internal structure of the aerosol generating device 2000 is not limited to the structures illustrated in FIGS. 18 to 20. In other words, according to the design of the aerosol generating device 2000, the battery 2100, the controller 2200, the cartridge 2400, and the heater 2300 may be differently arranged.

When the cigarette 3000 is inserted into the aerosol generating device 2000, the aerosol generating device 2000 may operate the heater 2300 and/or the cartridge 2400 to generate aerosol. The aerosol generated by the heater 2300 and/or the cartridge 2400 is delivered to the user by passing through the cigarette 3000.

If necessary, even when the cigarette 3000 is not inserted into the aerosol generating device 2000, the aerosol generating device 2000 may heat the heater 2300.

The battery 2100 may supply power to be used for the aerosol generating device 2000 to operate. For example, the battery 2100 may supply power to heat the heater 2300 or the cartridge 2400 and may supply power for operating the controller 2200. Also, the battery 2100 may supply power for operations of a display, a sensor, a motor, etc. mounted in the aerosol generating device 2000.

The controller 2200 may control overall operations of the aerosol generating device 2000. In detail, the controller 2200 may control not only operations of the battery 2100, the heater 2300, and the cartridge 2400, but also operations of other components included in the aerosol generating device 2000. Also, the controller 2200 may check a state of each of the components of the aerosol generating device 2000 to determine whether or not the aerosol generating device 2000 is able to operate.

The controller 2200 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The heater 2300 may be heated by the power supplied from the battery 2100. For example, when the cigarette 3000 is inserted into the aerosol generating device 2000, the heater 2300 may be located outside the cigarette 3000. Thus, the heated heater 2300 may increase a temperature of at least one material including beads in the cigarette 3000.

The heater 2300 may include an electro-resistive heater. For example, the heater 2300 may include an electrically conductive track, and the heater 2300 may be heated when currents flow through the electrically conductive track. However, the heater 2300 is not limited to the example described above and may include any other heaters which may be heated to a desired temperature. Here, the desired temperature may be pre-set in the aerosol generating device 2000 or may be manually set by a user.

As another example, the heater 2300 may include an induction heater. In detail, the heater 2300 may include an electrically conductive coil for heating a cigarette by an induction heating method, and the cigarette may include a susceptor which may be heated by the induction heater.

For example, the heater 2300 may include a tube-type heating element, a plate-type heating element, a needle-type heating element, or a rod-type heating element, and may heat the inside or the outside of the cigarette 3000, according to the shape of the heating element.

Also, the aerosol generating device 10000 may include a plurality of heaters 13000. Here, the plurality of heaters 2300 may be inserted into the cigarette 3000 or may be arranged outside the cigarette 3000. Also, some of the plurality of heaters 2300 may be inserted into the cigarette 3000, and the others may be arranged outside the cigarette 3000. In addition, the shape of the heater 2300 is not limited to the shapes illustrated in FIGS. 18 to 20 and may include various shapes.

The cartridge 2400 may generate aerosol by heating at least one bead and the generated aerosol may pass through the cigarette 3000 to be delivered to a user. In other words, the aerosol generated via the cartridge 2400 may move along an air flow passage of the aerosol generating device 2000 and the air flow passage may be configured such that the aerosol generated via the cartridge 2400 passes through the cigarette 3000 to be delivered to the user. Here, the cartridge 2400 is as described with reference to FIGS. 13 to 17.

The aerosol generating device 2000 may further include general-purpose components in addition to the battery 2100, the controller 2200, the heater 2300, and the cartridge 2400. For example, the aerosol generating device 2000 may include a display capable of outputting visual information and/or a motor for outputting haptic information. Also, the aerosol generating device 2000 may include at least one sensor (a puff detecting sensor, a temperature detecting sensor, a cigarette insertion detecting sensor, etc.). Also, the aerosol generating device 2000 may be formed as a structure where, even when the cigarette 3000 is inserted into the aerosol generating device 2000, external air may be introduced or internal air may be discharged.

Although not illustrated in FIGS. 18 to 20, the aerosol generating device 2000 and an additional cradle may form together a system. For example, the cradle may be used to charge the battery 2100 of the aerosol generating device 2000. Also, the heater 2300 may be heated when the cradle and the aerosol generating device 2000 are coupled to each other.

The cigarette 3000 may be similar to a general combustive cigarette. For example, the cigarette 3000 may be divided into a first portion including at least one bead and a second portion including a filter, etc. Alternatively, the second portion of the cigarette 3000 may also include an aerosol generating material.

The entire first portion may be inserted into the aerosol generating device 2000, and the second portion may be exposed to the outside. Alternatively, only a portion of the first portion may be inserted into the aerosol generating device 2000. Alternatively, a portion of the first portion and a portion of the second portion may be inserted into the aerosol generating device 2000. The user may puff aerosol while holding the second portion by the mouth. In this case, the aerosol is generated by the external air passing through the first portion, and the generated aerosol passes through the second portion and is delivered to the user's mouth.

For example, the external air may flow into at least one air passage formed in the aerosol generating device 2000. For example, opening and closing of the air passage and/or a size of the air passage may be controlled by the user. Accordingly, the amount and smoothness of vapor may be adjusted by the user. As another example, the external air may flow into the cigarette 3000 through at least one hole formed in a surface of the cigarette 3000.

Those of ordinary skill in the art pertaining to the present embodiments can understand that various changes in form and details can be made therein without departing from the scope of the characteristics described above. The disclosed methods should be considered in a descriptive sense only and not for purposes of limitation. The scope of the present disclosure is defined by the appended claims rather than by the foregoing description, and all differences within the scope of equivalents thereof should be construed as being included in the present disclosure.

What is claimed is:

1. An aerosol-generating article comprising:

agar;

glycerin; and water, wherein the aerosol-generating article maintains a shape of a bead by itself at room temperature, wherein aerosol is generated from the aerosol-generating article heated by an electric heater included in an aerosol-generating device, and wherein the aerosol-generating article includes 2.0 wt % to 2.5 wt % of the agar, 70 wt % of the glycerin, 0.05 wt % to 0.15 wt % of the alginate, and 27.5 wt % to 28.0 wt % of the water, or includes 2.5 wt % of the agar, 60 wt % to 80 wt % of the glycerin, 0.05 wt % to 0.15 wt % of the alginate, and 17.5 wt % to 37.5 wt % of the water, thereby exhibiting excellent moldability.

2. The aerosol-generating article of claim 1, wherein the heater is inserted into a cigarette or cartridge comprising the aerosol-generating article and heats the aerosol-generating article.

3. The aerosol-generating article of claim 1, wherein the heater heats the aerosol-generating article from outside of a cigarette or cartridge comprising the aerosol-generating article.

4. The aerosol-generating article of claim 1, wherein the heater generates the aerosol by heating a material generated by liquefying the aerosol-generating article.

5. A cigarette comprising the aerosol-generating article of claim 1 and at least one filter.

6. A cartridge comprising: an accommodating portion configured to accommodate the aerosol-generating article of claim 1 and at least one heater.

* * * * *